US007846078B1

(12) United States Patent
Park

(10) Patent No.: US 7,846,078 B1
(45) Date of Patent: Dec. 7, 2010

(54) EXERCISE APPARATUS

(76) Inventor: Othili Park, 34 Providence St., West Warwick, RI (US) 02893

( * ) Notice: Subject to any disclaimer, the term of this patent is extended or adjusted under 35 U.S.C. 154(b) by 12 days.

(21) Appl. No.: 12/410,872

(22) Filed: Mar. 25, 2009

Related U.S. Application Data

(60) Provisional application No. 61/045,990, filed on Apr. 18, 2008.

(51) Int. Cl.
*A63B 21/00* (2006.01)

(52) U.S. Cl. ..... 482/121; 482/126

(58) Field of Classification Search ..... 482/121, 482/126, 91, 80, 81
See application file for complete search history.

(56) References Cited

U.S. PATENT DOCUMENTS 6,402,668 B1 6/2002 Harker
2006/0258520 A1* 11/2006 Bowser ..... 482/121

* cited by examiner

*Primary Examiner*—Jerome Donnelly
(74) *Attorney, Agent, or Firm*—Salter & Michaelson

(57) ABSTRACT

An exercise apparatus that includes a bar member having opposed ends with each end being a closed end and having adjacent to the closed end an open channel defined by an elongated slot. An elastic member with handles attached to respective ends of the elastic member and a cap member disposed about the closed end of the bar member for retaining the handle in place. A method of attachment is also illustrated.

21 Claims, 10 Drawing Sheets

EXERCISE APPARATUS

RELATED CASES

Priority for this application is hereby claimed under 35 U.S.C. §119(e) to commonly owned and co-pending U.S. Provisional Patent Application No. 61/045,990 which was filed on Apr. 18, 2008 and which is incorporated by reference herein in its entirety.

TECHNICAL FIELD

The present invention relates in general to exercise equipment and pertains, more particularly, to exercise equipment that incorporates an elastic member and a bar.

BACKGROUND OF THE INVENTION

A slotted exercise apparatus is disclosed in U.S. Pat. No. 6,402,668. This particular exercise apparatus uses a rigid main support bar and a stretchable elastic member that is connected to opposite ends of the bar at respective handles.

It is an object of the present invention to provide an improved exercise apparatus particularly one with improved means for attaching the elastic member to the exercise bar.

Another object of the present invention is to provide an improved exercise device that is characterized by using a simplified means of attachment of end handles to the exercise bar.

Still another object of the present invention is to provide an improved exercise device that is characterized by the ability to interlock and readily release the end handles from the exercise bar.

SUMMARY OF THE INVENTION

The present invention incorporates a rigid exercise bar that is preferably hollow or may have hollow sections, particularly at the ends thereof. A stretchable band is connected at opposite ends to respective ends of the exercise bar. For this purpose, the ends of the exercise bar are provided with closed ends and an elongated channel that is adapted to receive cylindrical shaped handles. Each of the handles includes a loop to which the elastic member is attached. The elongated slot has a lip for engaging one end of the cylindrical handle. A cap member is secured about the closed end of the bar for securing the other end of the handle. A passage communicates with the elongated channel for the purpose of initially receiving the handle therethrough in one embodiment thereof.

In accordance with other embodiments of the present invention there is provided an exercise apparatus that is comprised of a bar member having opposed ends with each end being a closed end and having adjacent to the closed end an open channel defined by an elongated slot, an elastic member and handles attached to respective ends of the elastic member, the length of each handle being greater than the length of the elongated slot, and a cap member disposed about the closed end of the bar member for retaining the handle in place.

In accordance with other aspects of the present invention the channel may define a lip under which one end of the handle extends; including a passage hole in the channel for receiving therethrough the handle; wherein the passage hole is disposed at a position directly opposite to the elongated slot; wherein the passage hole has a diameter just larger than the diameter of the handle; wherein the handle also includes a loop having opposed loop ends; wherein one of the loop ends is engaged to move the handle in a first direction and the other loop end is engaged to move the handle in the opposite direction.

In accordance with the invention there is an exercise apparatus this is comprised of a bar member having opposed ends with each end having adjacent thereto the an open channel that defines an elongated slot, an elastic member and handle attached to respective ends of the elastic member, the open channel also defining a lip for receiving one end of the handle, the elastic member being pulled in one direction for locking the handle and being pulled in another direction at a different location for releasing the handle.

In accordance with another aspect of the present invention there is provided a method of attaching an elastic member, that includes handle secured to respective ends of the elastic member, to an elongated bar member, that includes opposed ends each having an elongated open channel that is defined at least in part by an elongated slot in a sidewall of the bar member, said method comprising the steps of:

providing a passage hole in the bar member at a position across from the elongated slot;

passing the handles through the passage hole in a direction toward the elongated open channel;

re-positioning the handle relative to the bar member so that the handle lies in and along the elongated open channel;

whereby the handle is interlocked with the bar member.

DESCRIPTION OF THE DRAWINGS

Numerous other object, features and advantages of the present invention will now become apparent upon a review of the following detailed description when taken in conjunction with the following figures, in which.

DETAILED DESCRIPTION

Figure 1:
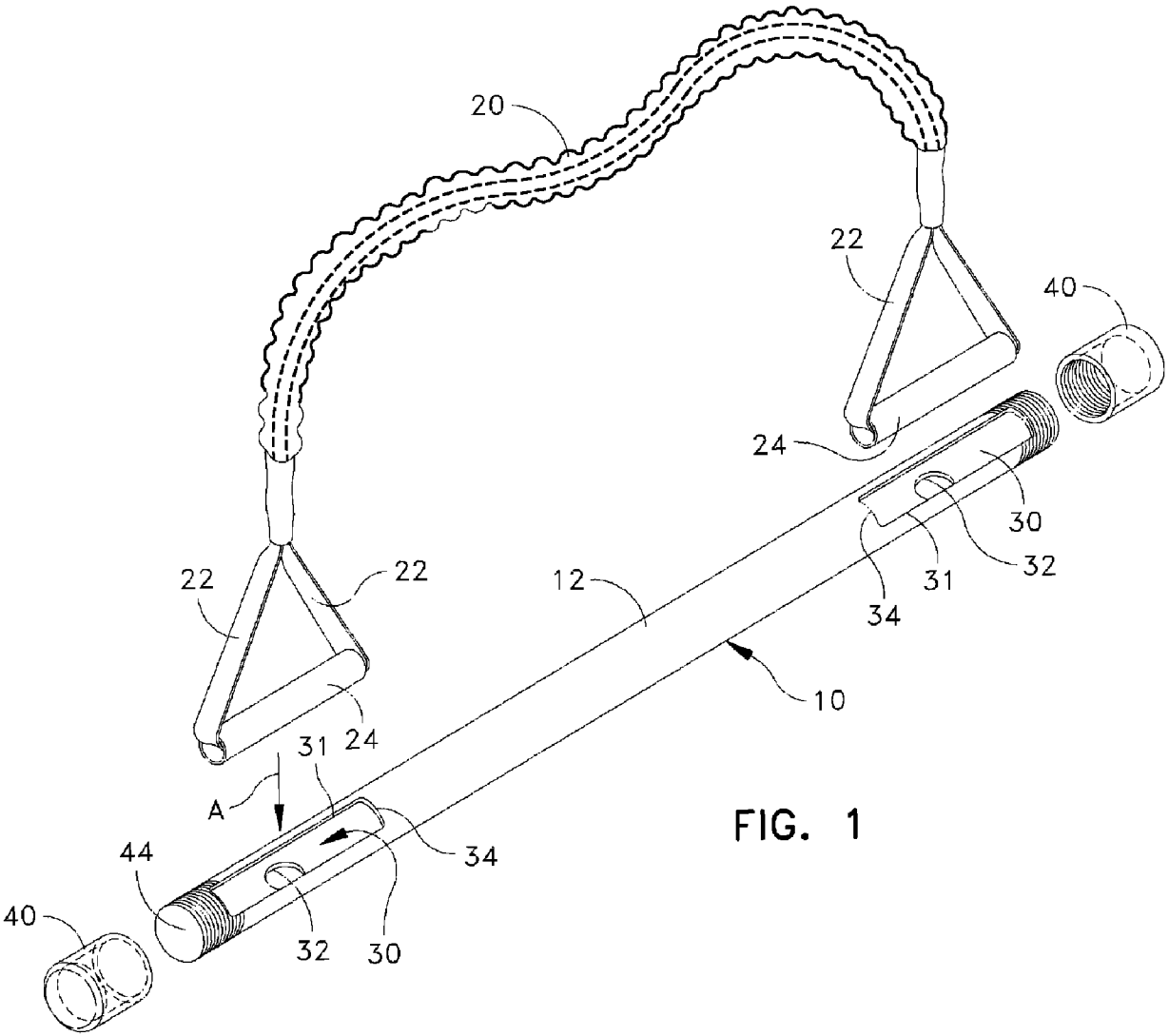
FIG. 1 is a perspective view illustrating one embodiment of the exercise apparatus of the present invention.

Reference is now made to the drawings and in particular to FIG. 1 which shows the exercise apparatus generally at 10. The exercise apparatus 10 is comprised of a bar 12 that may be constructed of a plastic material and may be provided in two separate sections although, FIG. 1 does not show the two separate sections. If two separate sections are employed then there might be some type of an intermediate engaging section disposed about midway between the two opposite ends of the bar 12. The intermediate engaging section may be a threaded section. The bar 12 that is illustrated in FIG. 1 may be considered as cylindrical although other cross-sectional shapes may be employed. The bar 12 is preferably hollow particularly at its ends but may also have sections that are internally solid.

FIG. 1 also illustrates the stretchable elastic member 20 that is attached at its respective ends to the handles 24. A loop 22 may be used for attaching the handle 24 to respective ends of the elastic member 20. It is considered that various different types of attachments may be used between the member 20 and the respective handles 24. The elastic member 20 is configured to have a certain longitudinal length and first and second ends. In one embodiment, the elastic member 20 is configured in a tubular shape having an inner cavity which traverses the longitudinal length of the elastic member 20. The elastic member 20 is formed of an elastic material which is defined herein as a material which is capable of returning to an original length or shape after being stretched. In one embodiment, the elastic material may comprise latex. In such an embodiment, the elastic member 20 may have a stretch of up to several times its original length. Latex materials have great elongation abilities with a material memory that allows it to return to nearly its original length even after repetitive use. Such capability is advantageous for exercise equipment. In alternative embodiments, the elastic material may comprise non-latex materials including natural rubber. Such alternative materials may be adequate for use in the present invention, provided that they are capable of stretching and retraction. However, generally such materials do not provide for the superior stretch afforded by latex based materials.

Figure 2:
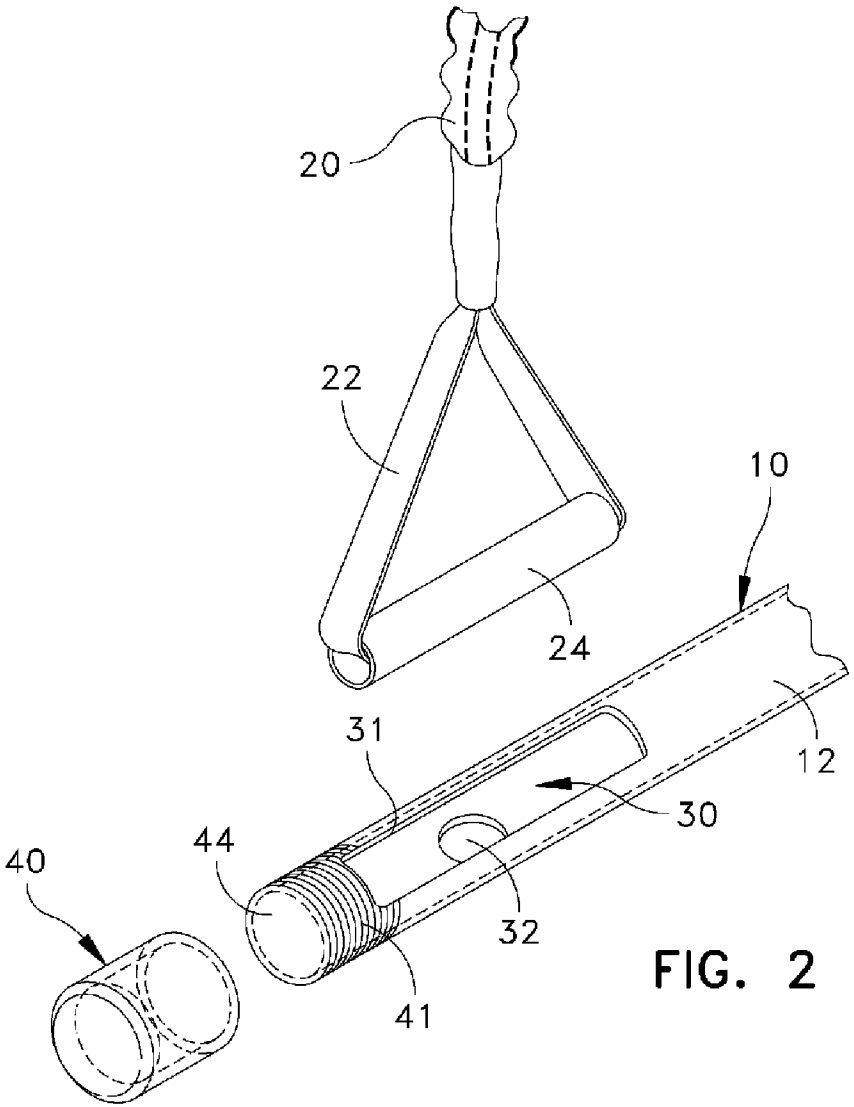
FIG. 2 is an exploded fragmentary view at one end of the exercise bar.
Figure 3:
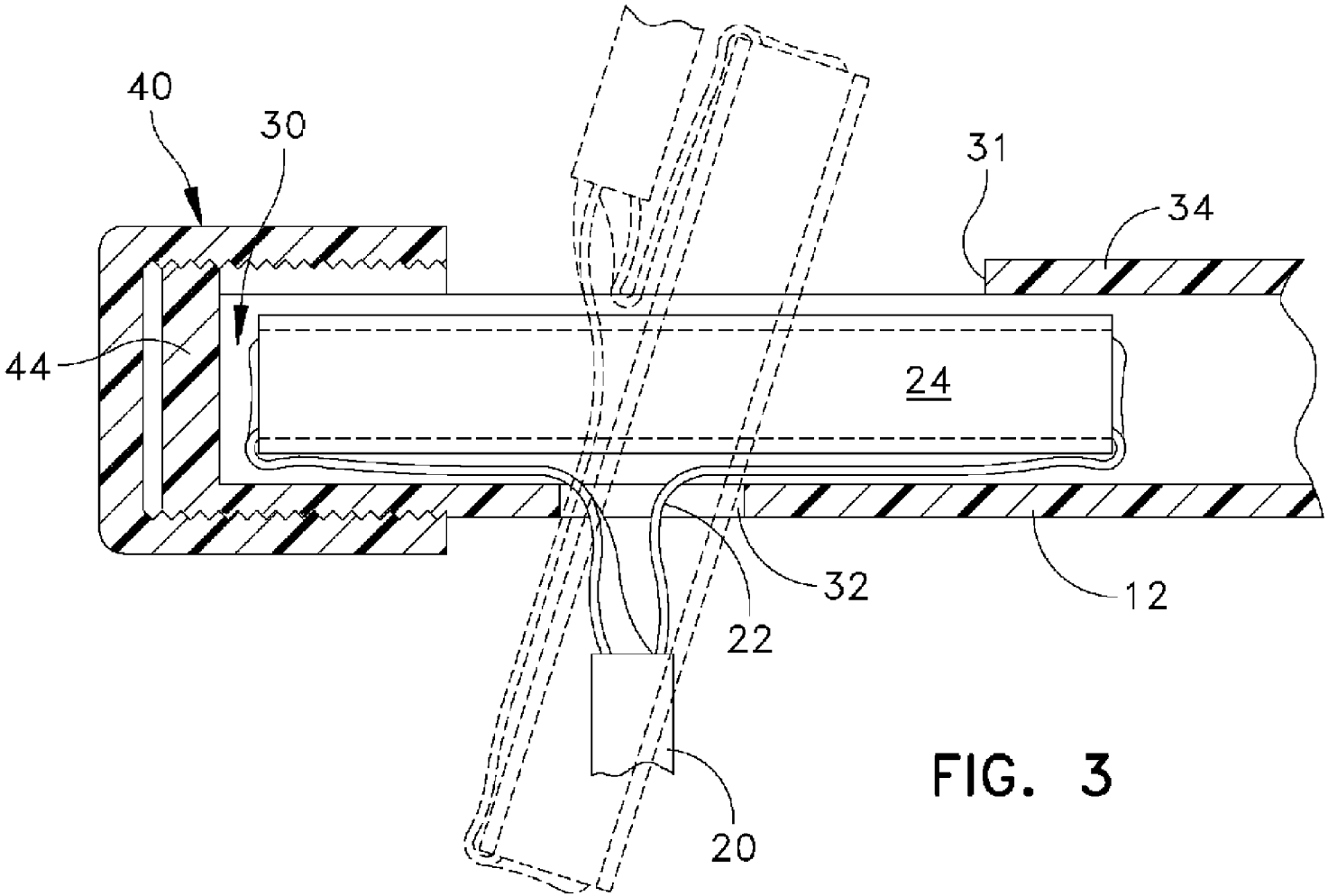
FIG. 3 is a cross-sectional view through the end of the bar illustrating one way that the handle is engaged with the bar.
Figure 4:
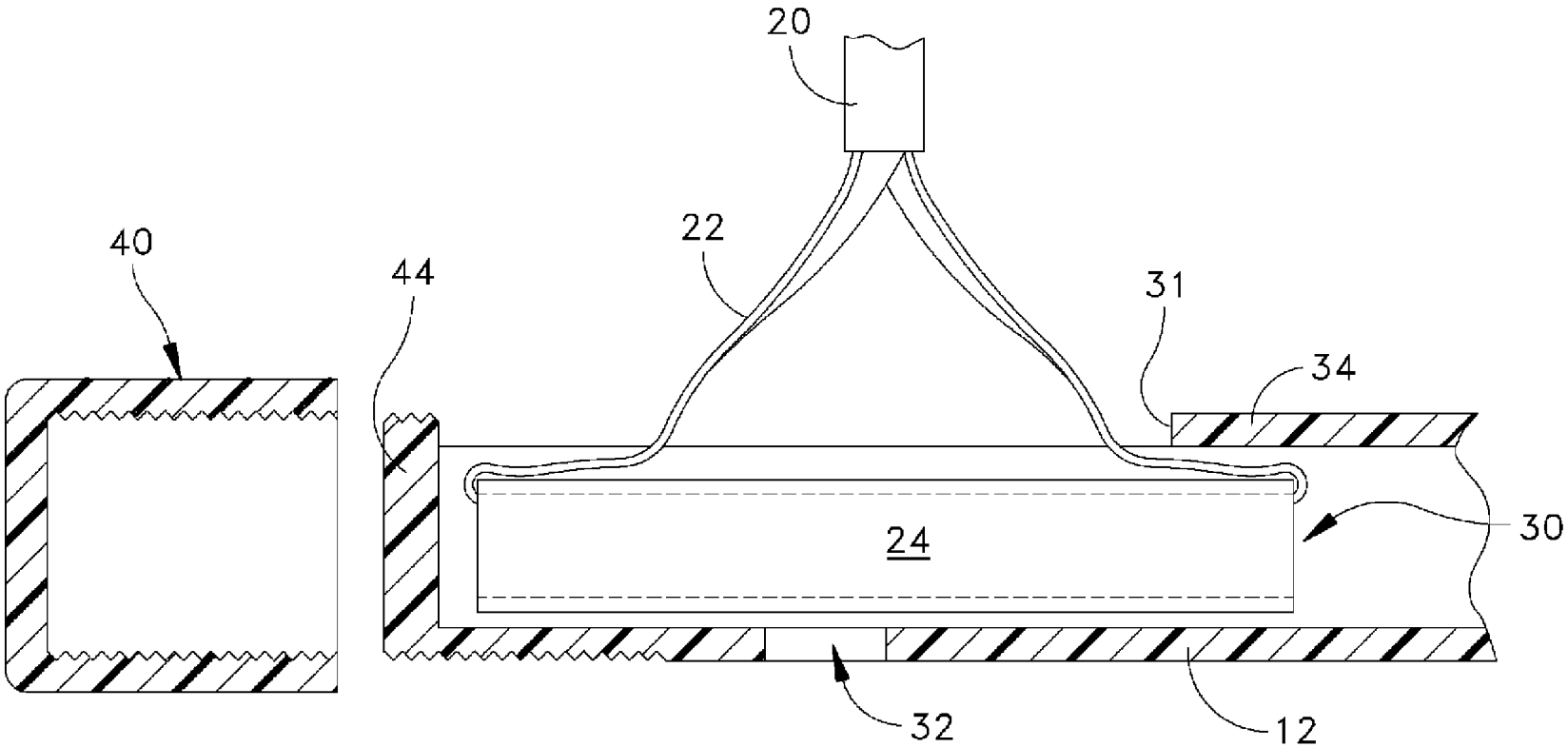
FIG. 4 is a cross-sectional view similar to that shown in FIG. 3 but illustrating another way that the handle is engaged with the bar.
Figure 5:
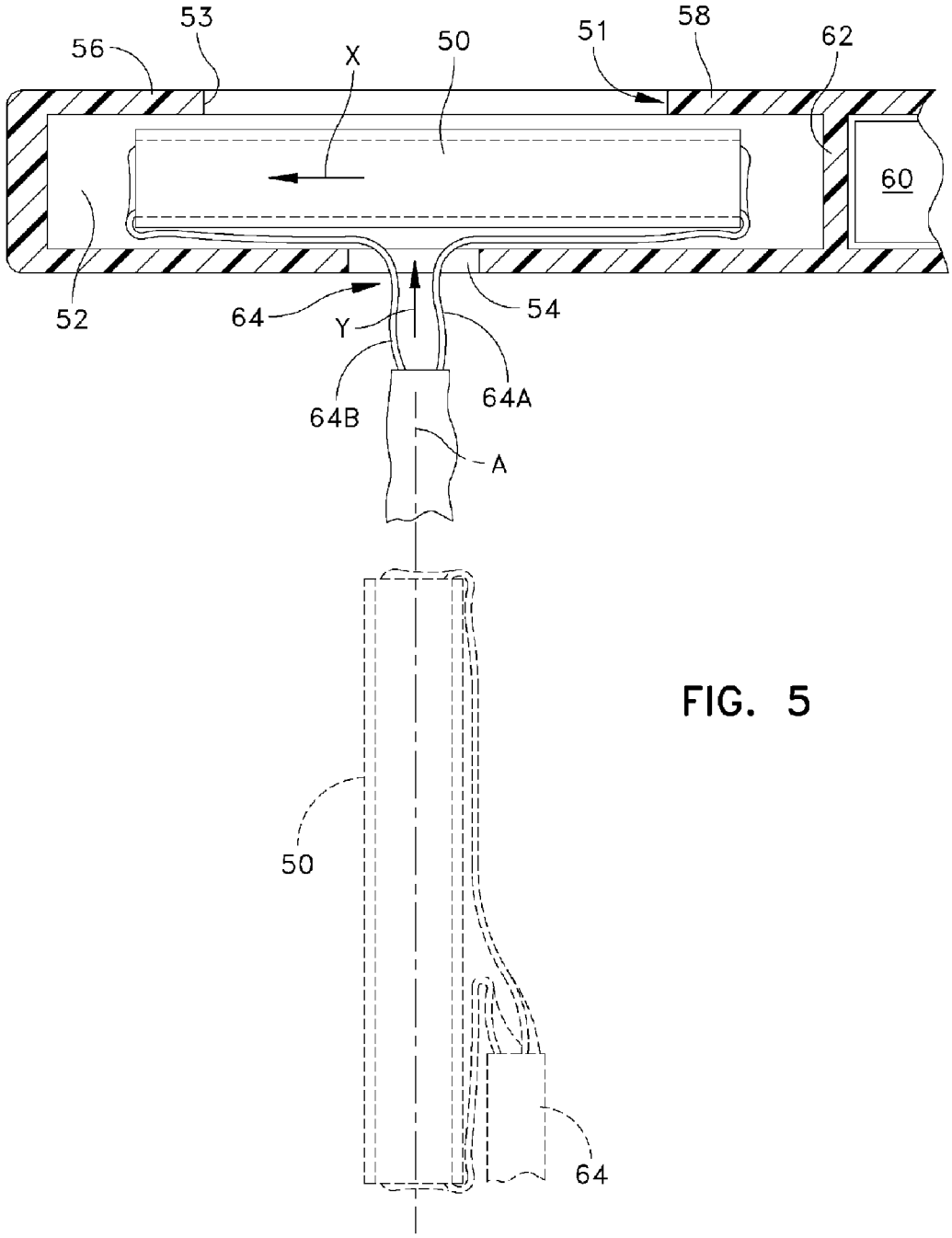
FIG. 5 illustrates an alternate embodiment of the present invention in which the end cap member is not used.

FIG. 1 also illustrates the elongated and cylindrically-shaped channels 30 that are disposed at each end of the rigid bar 12 and that are for the purpose of receiving the respective handles 24. In FIGS. 1-5 there are actually shown different ways that the handle can engage with the exercise bar. For example, FIGS. 1 and 4 show the handle engaging simply by the handles 24 moving toward the bar in a direction orthogonal to the longitudinal axis of the bar 12. See the directional arrow A in FIG. 1. In FIGS. 3 and 5 the handle is engaged with the exercise bar by passing through the passage hole 32. The passage hole 32 is provided at the bottom of the channel 30 at a position opposite to the sidewall slot 31 that is formed and leads into the channel 30.

In the embodiment of FIG. 1, and as also illustrated in FIG. 4, the handle 24 is maintained in place by using an end cap 40. For this purpose the end cap is internally threaded while the end wall 44 is externally threaded. In this embodiment the passage hole 32 is optional as the handle is not passed therethrough. Each of the slots 31 preferably has a length that is shorter than the length of its associated handle 24 thus defining a lip 34 that enables one end of the handle to be inserted thereunder, as shown in FIG. 4. In this regard refer also to FIGS. 3 and 4 for an illustration of the lip 34 and the manner in which the handle 24 is positionable under the lip 34 for retaining one end of the handle 24. The other end of the handle 24 is secured in place by means of an end cap 40. In this regard refer to FIG. 1 which shows oppositely disposed end caps 40. FIG. 2 also shows the end cap 40 preferably with an internal thread that engages with external threads 41. Refer also to FIG. 3 which shows the end cap 40 in place on the end wall 44 of the bar 12. Thus, it is noted that each end of the bar 12 is not open but instead is closed by the wall indicated at 44 in FIG. 3. In an alternate arrangement the end may be open but still provided with threads or the like. Refer also to the closed end 44 illustrated in FIG. 2. FIG. 3 illustrates the manner in which the cap 44 extends over the left hand end of the handle 24 for securing the handle in place. Thus, between the cap 40 and the lip 34 the handle 24 is in a secure position and thus firmly attached at both ends of the elastic member 20 to the bar 12.

As indicated before, the bar is provided with an opposed passage hole 32 that is in particular used in the embodiment of FIGS. 3 and 5. The diameter of passage hole 32 is preferably slightly larger than the outer diameter of the handle 24. FIGS. 3 and 4 illustrate two different ways that the handle can be engaged with the bar. The version illustrated in FIG. 3 is preferred although, one may also use the version illustrated in FIG. 4.

For the embodiment of FIG. 3 the handle 24 first passes through the hole 32. This is before the end cap 40 is secured in place at the closed end of the bar. Once the handle 24 is passed through the hole 32 then it is positioned as shown in FIG. 3 with one end captured under the lip 34 that is defined at one end of the channel 30. Next, the cap 40 is screwed or fastened in another way onto the closed end of the bar with the cap 40 extending over the other end of the handle 24 as is clearly illustrated in FIG. 3. In FIG. 3 the handle is show in an initial position in dotter outline passing through the passage hole 32. In FIG. 4 the final placement of the handle fully in the channel 30 is illustrated in solid outline.

The embodiment of FIG. 4 is one in which the handle 24 does not pass through the hole 32 and as a matter of fact the hole 32 then becomes optional. FIG. 4 illustrates wherein the handle 24 is simply placed within the channel 30 with the right hand end under the lip 34. In FIG. 4 the cap 40 is shown exploded away from the closed end of the bar. However, the cap 34 would be secured to a position as illustrated in FIG. 3 so as to capture the left hand end of the handle 24.

Reference is now made to FIG. 5 for an alternate way of securing the handle 50 at each end of the exercise bar, and in a manner like that described in connection with FIG. 3. In this particular embodiment, in FIG. 5 there is disclosed only a fragmentary end view. It is understood that similar constructions are also used at the other end of the exercise bar. Thus, channels 52 is disposed at each end of the rigid bar for the purpose of receiving the respective handles 50. A slot 51 leads into each channel 52. At the bottom of the channel 52 there is provided a passage hole 54 opposite to the slot 51 and for receiving a respective handle 50 at an initial positioning of the handle. In this regard in FIG. 5 the handle 50 is shown at a lower most position, in dotted outline, where it will be moved along the axis A through the passage hole 54 for positioning eventually at an upper position as also illustrated in FIG. 5 in solid outline. The handle is rotated through 90 degrees to move from the straight in position to the rest position shown in solid outline in FIG. 5. As indicated before, the channel 52 includes an opening or slot 51. The length of the opening or slot 51 is shorter than the length of the associated handle 50. This defines a lip 56 at the outer end of the bar. The embodiment of FIG. 5 also shows another lip 58 which is provided at the opposite end of the slot. Alternatively, a lip may be provided only at either end of the channel 52.

The apparatus of FIG. 5 also includes a weight 60. There is a weight preferably provided associated closely to the handle at each end of the exercise bar. The weight 60 may be force fit into the bar. A wall 62 may be provided for holding the weight in place. As shown in FIG. 5, in comparison to the embodiment of FIG. 3, this embodiment does not require the use of an end cap such as the end caps 40 illustrated in the first embodiment.

Each of the handles 50 also includes a grasping loop 64. The loop 64 may pass through the handle 50 which may be a hollow cylinder. Once the handle is in place as shown in the upper position of FIG. 5, then one can pull downwardly at 64A on the loop 64 to slide the handle in the direction of arrow X to thus assure that the handle is in place under the lip 56. The handle 50 can also be disengaged by alternatively pulling downwardly at location 64B of the loop 64. This will slide the handle in the direction opposite to direction X. Also, a finger can be applied through the hole 54 in the direction of arrow Y to assist in removing the handle from the channel 52. When the handle is moved to the right in FIG. 5 then the left edge of the handle is preferably positioned so that it can be lifted out of the channel. In that way when the loop 64 is pulled at 64B, the handle tends to lift from the channel and can thus be disengaged.

Figure 6:
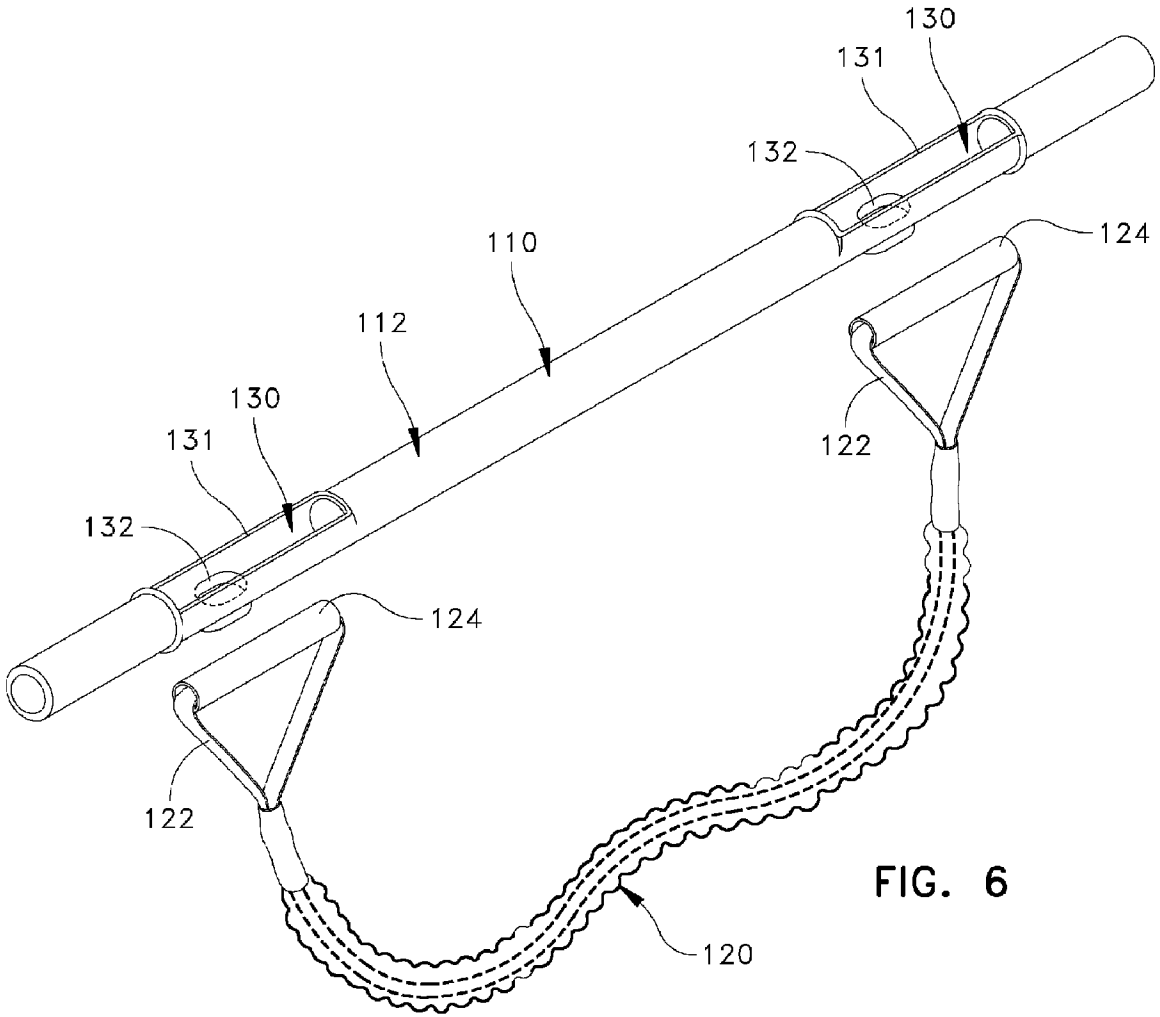
FIG. 6 is a perspective view illustrating another embodiment of the exercise apparatus of the present invention.

Reference is now made to a further embodiment of the present invention in FIGS. 6-11 and similar to the embodiment of FIG. 3 but without requiring the use of an end cap. The exercise apparatus 110 is comprised of a bar 112 that may be constructed of a plastic material and may be provided in two separate sections. If two separate sections are employed then there might be some type of an intermediate engaging section disposed about midway between the two opposite ends of the bar 112. The intermediate engaging section may be a threaded section. The bar 112 that is illustrated in FIG. 6 may be considered as cylindrical although other cross-sectional shapes may be employed. The bar 112 is preferably hollow particularly at its ends but may also have sections that are internally solid.

FIG. 6 also illustrates the stretchable elastic member 120 that is attached at its respective ends to the handles 124. A loop 122 may be used for attaching the handle 124 to respective ends of the elastic member 120. It is considered that various different types of attachments may be used between the member 120 and the respective handles 124. The elastic member 122 is configured to have a certain longitudinal length and first and second ends. In one embodiment, the elastic member 120 is configured in a tubular shape having an inner cavity which traverses the longitudinal length of the elastic member 120. The elastic member 120 is formed of an elastic material which is defined herein as a material which is capable of returning to an original length or shape after being stretched. In one embodiment, the elastic material comprises latex. In such an embodiment, the elastic member 120 may have a stretch of up to several times its original length. Latex materials have great elongation abilities with a material memory that allows it to return to nearly its original length even after repetitive use. Such capability is advantageous for exercise equipment. In alternative embodiments, the elastic material may comprise non-latex materials including natural rubber. Such alternative materials may be adequate for use in the present invention, provided that they are capable of stretching and retraction. However, generally such materials do not provide for the superior stretch afforded by latex based materials.

Figure 7:
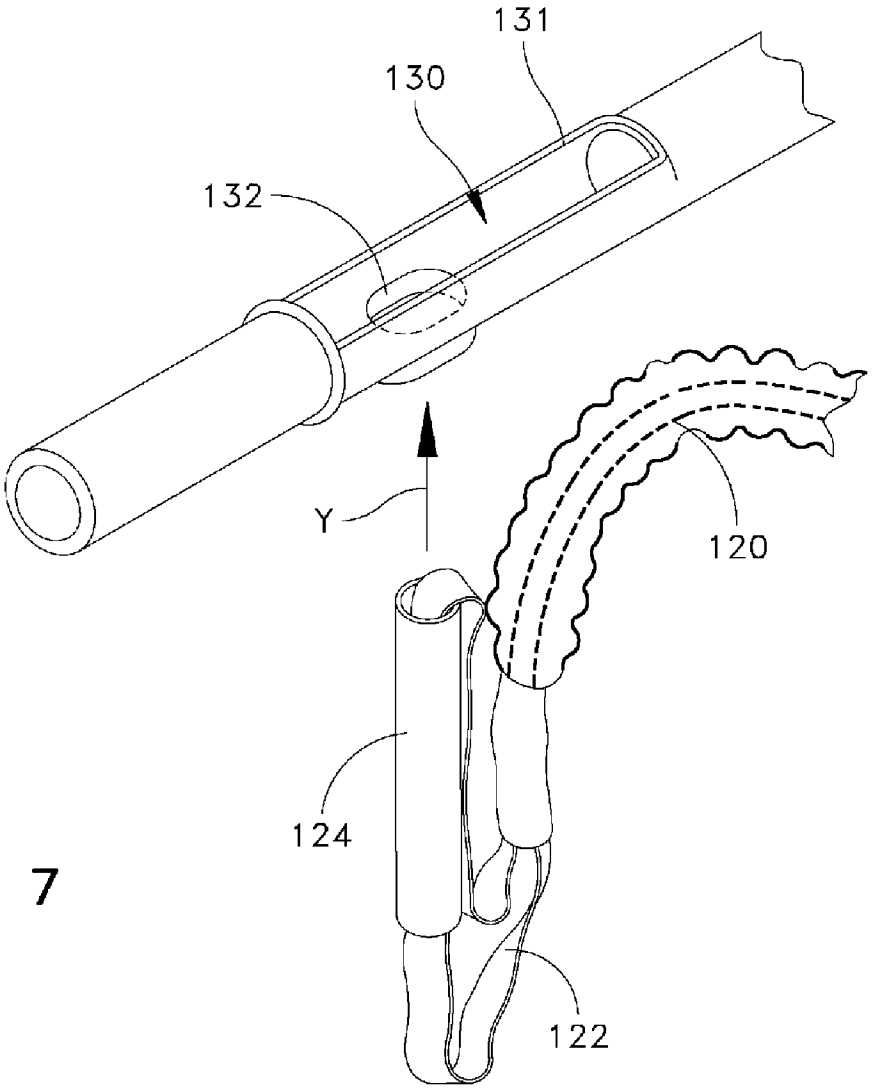
FIG. 7 is an exploded fragmentary view at one end of the exercise bar of FIG. 6.
Figure 8:
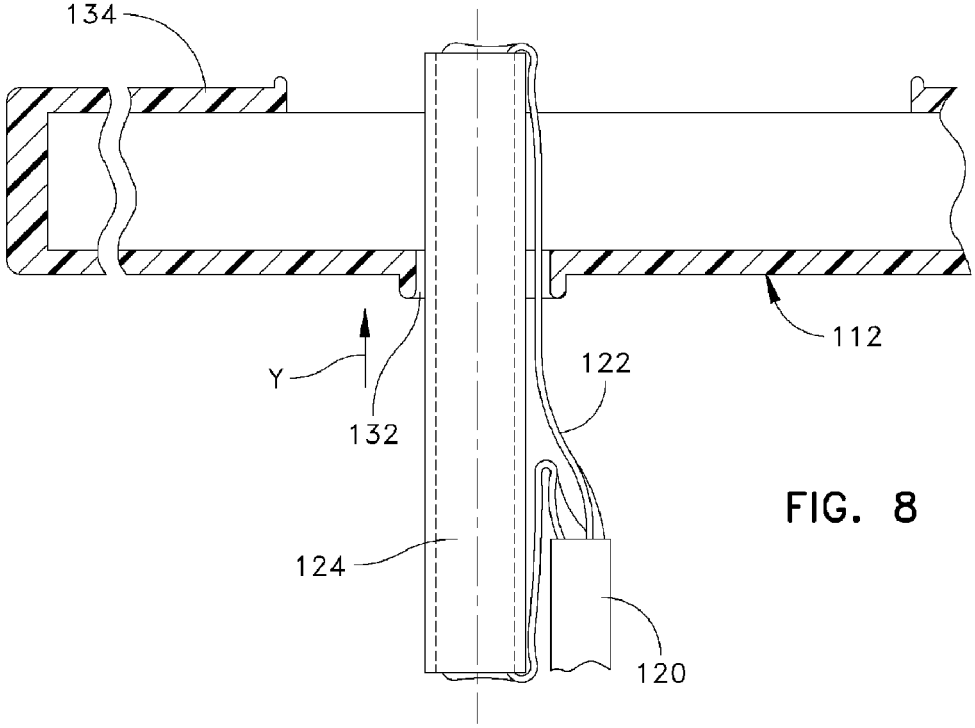
FIG. 8 is a cross-sectional view through the end of the bar illustrating a first step in which the handle is engaged with the bar.
Figure 9:
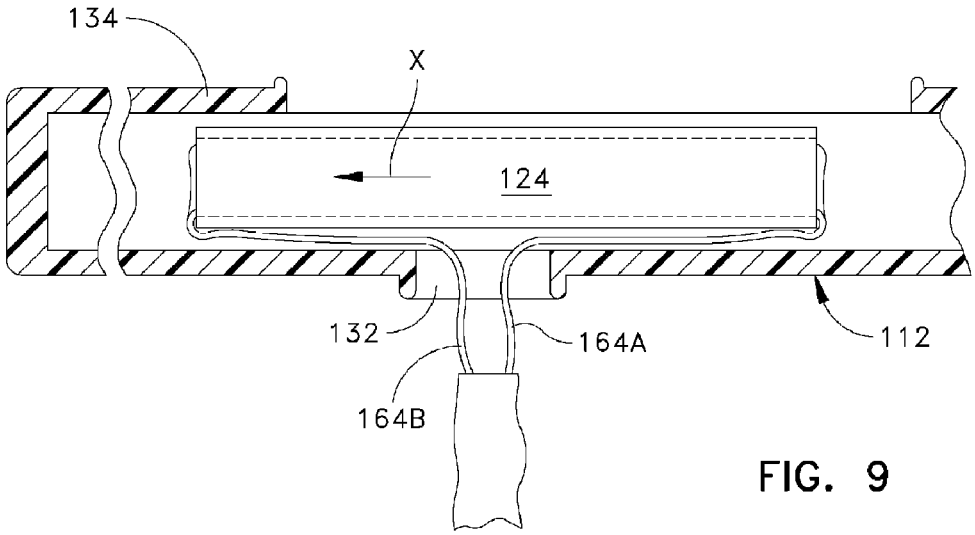
FIG. 9 is a cross-sectional view similar to that shown in FIG. 8 but illustrating the handle fully engaged with the bar.

FIG. 6 also illustrates the elongated channels 130 that are disposed at each end of the rigid bar 112 and that are for the purpose of receiving the respective handles 124. In FIGS. 7-11 further details are given of this embodiment. The channels are formed by slots or openings 131 in the outer sidewall of the bar. The bar 112 is provided with a passage hole 132 that is preferably disposed opposite to the slot 131. The diameter of passage hole 132 is preferably slightly larger than the outer diameter of the handle 124. For the embodiment of FIG. 6 the handle 124 first passes through the hole 132, as illustrated in FIGS. 7 and 8, such as shown by arrow Y. Once the handle 124 is passed through the hole 132 then it is positioned as shown in FIG. 9 with one end captured under the lip 134 that is defined at one end of the channel 130. In FIG. 8 the handle is show in an initial position passing through the passage hole 132. In FIG. 9 the final placement of the handle fully in the channel 130 is illustrated.

Figure 10:
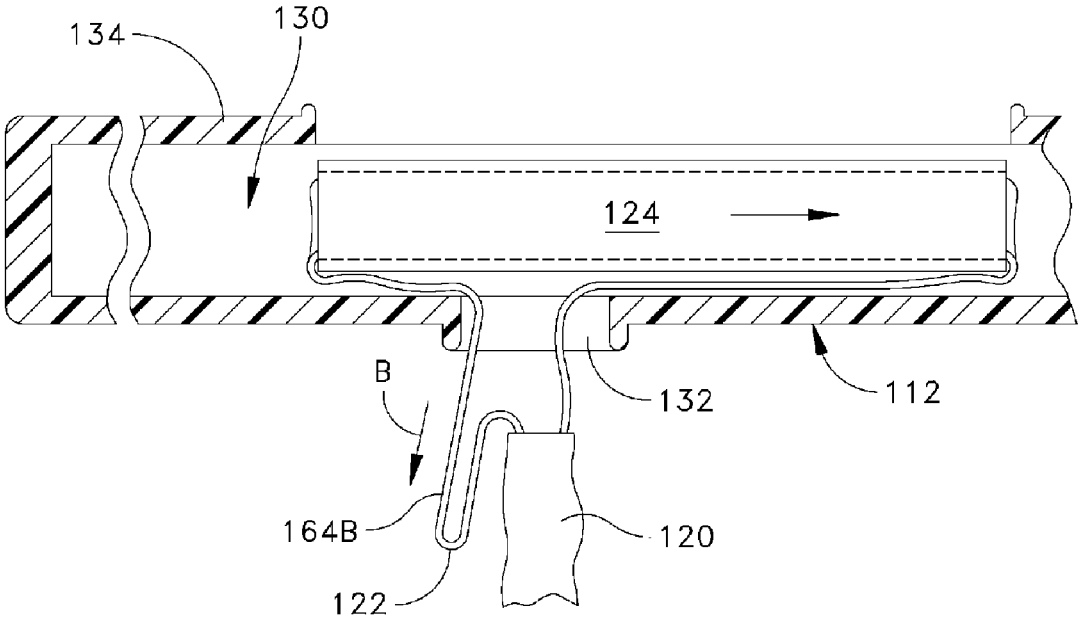
FIG. 10 is a cross-sectional view similar to that shown in FIGS. 8 and 9 but illustrating how the handle can be disengaged with the bar.

Each of the handles 124 also includes a grasping loop 122. The loop 122 may pass through the handle 124 which may be a hollow cylinder. Once the handle is in place as shown in FIG. 9, then one can pull downwardly at 164A on the loop 164 to slide the handle in the direction of arrow X to thus assure that the handle is in place under the lip 134. FIG. 9 shows the movement in the X direction. The handle 124 can also be disengaged by alternatively pulling downwardly at location 164B of the loop 64, as illustrated in FIG. 10 by arrow B. This will slide the handle in the direction opposite to direction X. Also, a finger can be applied through the hole 54 in the direction of arrow Y to assist in removing the handle from the channel 52. When the handle is moved to the right in FIG. 10 then the left edge of the handle is preferably positioned so that it can be lifted out of the channel. In that way when the loop 122 is pulled at 164B, the handle tends to lift from the channel.

Figure 11:
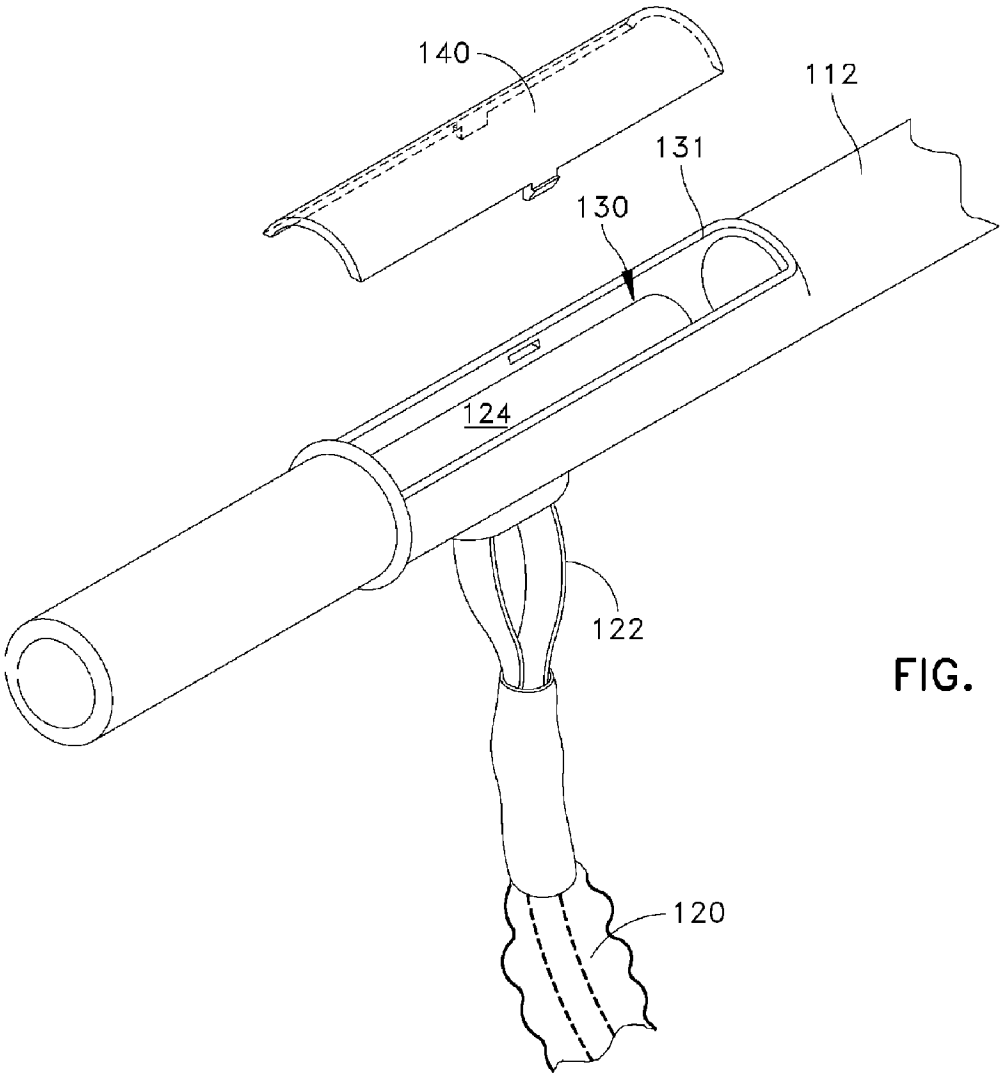
FIG. 11 is a partial perspective view of the embodiment of FIG. 6.

FIG. 11 is a perspective view like that shown in FIG. 6 but illustrating just the end of the exercise bar 112. In FIG. 11 the handle 124 is shown in place in the channel 130. FIG. 11 also shows the cover 140 that may be engaged over the channel 130, thus covering the handle 124.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. An exercise apparatus that is comprised of a walled hollow bar member having opposed ends and each end having an open channel defined by an elongated slot in a sidewall of the hollow bar member, an elastic member and elongated handle attached to respective ends of the elastic member, the elongated handle having a rest position and an insert position, the width of the elongated slot being greater than the diameter of the handle so that the handle can rest in the channel in the rest position thereof, the walled hollow bar member having a through hole through the sidewall thereof and leading into the open channel, disposed at a position about the hollow bar member that is opposite to the elongated slot and for receiving therethrough the handle in the insert position thereof.

2. The exercise apparatus of claim 1 wherein the channel defines a lip under which one end of the handle extends.

3. The exercise apparatus of claim 1 including a cap member disposed at least one end of the walled hollow bar member to assist in retaining the handle in the rest position thereof.

4. The exercise apparatus of claim 1 wherein each opposed end of the walled hollow bar member is closed.

5. The exercise apparatus of claim 1 wherein the through hole of the hollow bar member has a diameter just larger than the diameter of the handle.

6. The exercise apparatus of claim 1 wherein the handle also includes a loop having opposed loop ends.

7. The exercise apparatus of claim 6 wherein one of the loop ends is engaged to move the handle in a first direction and the other loop end is engaged to move the handle in the opposite direction.

8. An exercise apparatus this is comprised of a bar member including a tubular wall member having opposed ends with each end having adjacent thereto an open channel that is defined at least in part by an elongated slot in a sidewall of the tubular wall member, an elastic member and handle attached to respective ends of the elastic member, the open channel also defining a lip for receiving thereunder one end of the handle, the tubular wall member also having a passage hole through the sidewall of the bar member and leading to said channel, disposed across from said elongated slot, and for receiving therethrough the handle, the width of the elongated slot being greater that the diameter of the handle so that the handle can rest in the channel in the rest position thereof, the elastic member being pulled in one direction for locking the handle and being pulled in another direction at a different location for releasing the handle.

9. The exercise apparatus of claim 8 wherein the channel defines a second lip under which an end of the handle extends.

10. The exercise apparatus of claim 8 wherein said passage hole in the channel is disposed diametrically across from said elongated slot.

11. The exercise apparatus of claim 10 wherein the passage hole has a diameter greater than the diameter of the handle.

12. The exercise apparatus of claim 8 including a cap disposed about the end of the tubular wall member.

13. The exercise apparatus of claim 8 wherein the handle also includes a loop having opposed loop ends.

14. An exercise apparatus that is comprised of:

a hollow tubular member having opposed ends and a longitudinal axis extending therebetween;

each end of the tubular member having an open elongated channel defined by an elongated slot that is formed in a sidewall of the hollow tubular member;

an elastic member and elongated handles attached to respective ends of the elastic member;

and a through hole in the sidewall of the hollow tubular member and disposed across from the elongated slot;

the elongated handle having a rest position in which the elongated handle is secured with the elongated channel of the hollow tubular member, and an initial position in which the handle is being inserted at the through hole;

the width of the elongated slot being greater than the diameter of the elongated handle so that the handle can at least partially extend therethrough in being positioned in the channel at the rest position thereof.

15. The exercise apparatus of claim 14 including a cap member disposed about the end of the tubular member for retaining the handle in place.

16. The exercise apparatus of claim 14 wherein the passage hole is circular and the handle is cylindrical.

17. The exercise apparatus of claim 14 wherein the shape of the passage hole matches that of the handle cross-section.

18. The exercise apparatus of claim 17 wherein the passage hole communicates with the channel and is disposed diametrically opposite to the elongated slot.

19. The exercise apparatus of claim 14 wherein the length of each elongated slot is less than the length of the handle so that a lip is formed by the tubular member sidewall adjacent to at least one end of the elongated slot for capturing an end of the handle.

20. An exercise apparatus that is comprised of:

a walled hollow tubular member having opposed ends and a longitudinal axis extending therebetween;

each end of the walled hollow tubular member having an open elongated channel defined by an elongated slot that is formed in a sidewall of the hollow tubular member;

an elastic member and elongated handles attached to respective ends of the elastic member;

the elongated handle having a rest position in which the elongated handle is disposed within the elongated channel of the hollow tubular member, and an initial position in which the handle is disposed outside of the hollow tubular member;

a through hole in the sidewall of the hollow tubular member and disposed across from the elongated slot;

the width of the elongated slot being greater than the diameter of the elongated handle so that the handle can be displaced in a direction transverse to the longitudinal axis from the initial position thereof, through the elongated slot to the rest position thereof;

and a cap member disposed at least one end of the walled hollow tubular member to assist in retaining the handle in the rest position thereof by overlapping an end of the handle.

21. The exercise apparatus of claim 20 wherein the elongated slot also defining a lip for receiving thereunder one end of the handle.

* * * * *